US010889130B2

(12) United States Patent
Pucci et al.

(10) Patent No.: US 10,889,130 B2
(45) Date of Patent: Jan. 12, 2021

(54) DEVICE FOR PRINTING A CLOSURE DEVICE FOR CONTAINERS

(71) Applicant: SACMI IMOLA S.C., Imola (IT)

(72) Inventors: Fabrizio Pucci, Castel Guelfo di Bologna (IT); Fiorenzo Parrinello, Medicina (IT); Gastone Sassatelli, Mordano (IT)

(73) Assignee: SACMI IMOLA S.C., Imola (IT)

( * ) Notice: Subject to any disclaimer, the term of this patent is extended or adjusted under 35 U.S.C. 154(b) by 0 days.

(21) Appl. No.: 16/465,848

(22) PCT Filed: Dec. 1, 2017

(86) PCT No.: PCT/EP2017/081235
§ 371 (c)(1),
(2) Date: May 31, 2019

(87) PCT Pub. No.: WO2018/100183
PCT Pub. Date: Jun. 7, 2018

(65) Prior Publication Data

US 2020/0023651 A1 Jan. 23, 2020

(30) Foreign Application Priority Data

Dec. 2, 2016 (IT) ..... 102016000122417

(51) Int. Cl.
*B41J 3/407* (2006.01)
*B41J 11/00* (2006.01)

(52) U.S. Cl.
CPC ..... *B41J 3/4073* (2013.01); *B41J 11/007* (2013.01)

(58) Field of Classification Search
CPC ..... B41J 3/407; B41J 3/4073; B41J 11/007; B65D 55/022; B65D 55/024;
(Continued)

(56) References Cited

U.S. PATENT DOCUMENTS 5,432,437 A * 7/1995 Turner ..... B29C 65/3656 324/202
6,000,568 A * 12/1999 Verter ..... B65D 41/3404 215/252
(Continued)

FOREIGN PATENT DOCUMENTS

CN 202623522 U 12/2012
CN 103935122 A 7/2014
(Continued)

OTHER PUBLICATIONS

International Search Report dated Feb. 12, 2018 re: Application No. PCT/EP2017/081235, pp. 1-3, citing: WO 2015/011663 A1 and US 2016/159537 A1.
(Continued)

*Primary Examiner* — Anh T Vo
(74) *Attorney, Agent, or Firm* — Cantor Colburn LLP

(57) ABSTRACT

A device for printing a closure device for containers includes a first body and a second body each of which has a respective relative positioning element configured at least in a step of use of the closure device, to be arranged and/or oriented with respect to each other in a predetermined position. The printing device includes a supporting device for at least one of the bodies, a device for detecting the position or orientation of the relative positioning element of the body supported by the support device, and a device for digital printing of at least one portion of the body supported by the supporting device in order to perform a printing operation in a predetermined position and/or with a predetermined orientation with respect to the position and/or orientation of the respective relative positioning element.

7 Claims, 10 Drawing Sheets

(58) Field of Classification Search
CPC .. B65D 55/026; B65D 41/0457; G06K 1/125; G06K 7/10861; G06K 19/06009
See application file for complete search history.

(56) References Cited

U.S. PATENT DOCUMENTS

| | | | | |
|---|---|---|---|---|
| 2003/0052100 | A1 | 3/2003 | Philipp et al. | |
| 2016/0159537 | A1* | 6/2016 | Pucci | B65D 41/045 215/329 |
| 2016/0167395 | A1* | 6/2016 | Albonetti | B41J 11/002 347/102 |

FOREIGN PATENT DOCUMENTS

| | | | |
|---|---|---|---|
| CN | 104163047 | A | 3/2016 |
| CN | 105392577 | A | 3/2016 |
| CN | 105392631 | A | 3/2016 |
| CN | 205467909 | U | 8/2016 |
| WO | 2015010984 | A1 | 1/2015 |
| WO | 2015011663 | A1 | 1/2015 |

OTHER PUBLICATIONS

IT Search Report dated Jul. 19, 2017 re: Application No. 201600122417, pp. 1-7, citing: WO 2015/011663 A1, US 2003/052100 A1 and US 2016/159537 A1.
Written Opinion dated Feb. 12, 2018 re: Application No. PCT/EP2017/081235, pp. 1-6, citing: WO 2015/011663 A1 and US 2016/159537 A1.

* cited by examiner

DEVICE FOR PRINTING A CLOSURE DEVICE FOR CONTAINERS

TECHNICAL FIELD

The present disclosure relates to a device for printing a closure device for containers.

BACKGROUND

Systems are known and are widely used for manufacturing and for printing capsules for closing containers.

Traditionally the printing of plastic caps for closing containers is done by way of print rollers or print pads.

The production of plastic caps is generally done by way of a compression molding process or by way of injection molding.

In the first case, in output from the compression molding plant, the caps are deposited, still warm, with their head placed on a belt that transfers them to a storage magazine.

If the caps are manufactured by injection, the groups of caps are ejected from the mold, in a disordered fashion, into storage containers from which, subsequently, once they have cooled, they are withdrawn to be sent to the subsequent stations.

If the manufactured caps need to undergo a printing process, they are taken from the storage magazine or from the storage container to be fed to a belt or a chain which supports pins, also known as "holders", over which the caps to be printed are fitted.

The belt thus conveys the caps to a print station constituted, for example, by printing rollers or by pads which make contact with the upper surface of the cap.

From patent application WO2015011663 a plant is known for the manufacture and printing of cup-shaped bodies such as caps and the like made of plastic.

Such plant comprises an apparatus for manufacturing caps and a device for positioning the manufactured caps from the apparatus onto a transfer device.

The transfer device can move along a longitudinal transfer direction and the caps are placed on a resting surface defined by the transfer device with the cap concavity directed toward the resting surface.

Furthermore, the plant described in WO2015011663 comprises, along the extension of the longitudinal transfer direction, a device for digital printing of the caps.

Furthermore, there are means of controlling the position of the top edge of the caps on the resting surface: such control means are functionally connected to the digital printing device.

Also known, from patent application WO2015010984, is an apparatus for printing caps which comprises a transfer device which is associated in input with a feeder of caps to be printed and in output with an unloader of the printed caps.

The transfer device defines a plurality of seats to accommodate a respective cap and these are movable along a transfer trajectory that has a curvilinear extension, and in particular circular.

Safety capsules are furthermore known, which are provided with means of indicating that the first opening has occurred by way of the appearance of an indication or a wording that can be seen from outside the capsule.

Such capsules in general comprise an outer cap, designed to be screwed onto the neck of the container, and a guarantee disk or other guarantee component which, at least in a configuration prior to the first opening of the capsule, is removably coupled to the neck or to the opening of the container.

The outer cap is, for example, provided with at least one opening which faces onto the underlying guarantee disk, which presents in an upward region an indication that the first opening has occurred.

Upon the first opening of the capsule, the outer cap and the disk can rotate with respect to each other between a non-aligned position, in which the indication that the first opening has occurred is not visible from outside, and an aligned position, in which the indication that the first opening has occurred is visible from outside through the window or windows defined on the outer cap.

SUMMARY

The aim of the present disclosure is to make available a new device for printing closure devices for containers.

Within this aim, the disclosure provides a device for printing closure devices that is capable of ensuring a high level of productivity and precision.

This aim and these and other advantages which will become better apparent hereinafter are achieved by providing a device for printing closure devices according to the appended independent claims.

BRIEF DESCRIPTION OF THE DRAWINGS

Further characteristics and advantages of the disclosure will become better apparent from the description of some preferred, but not exclusive, embodiments of a device for printing closure devices according to the disclosure, which are illustrated by way of non-limiting example in the accompanying drawings wherein.

DETAILED DESCRIPTION OF THE DRAWINGS

Figure 1:
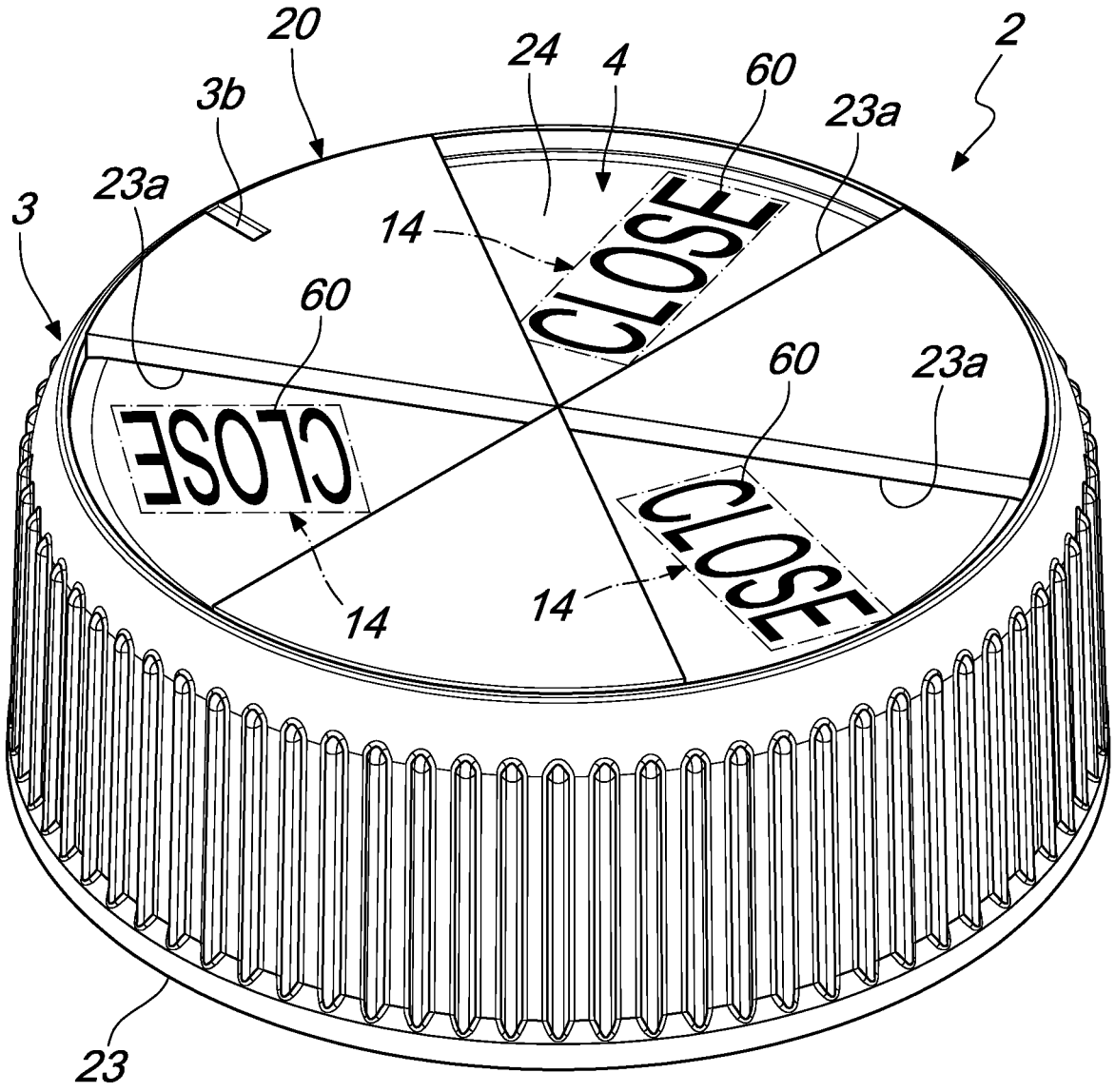
FIG. 1 is a perspective view of a first embodiment of a safety capsule showing the closure position.
Figure 2:
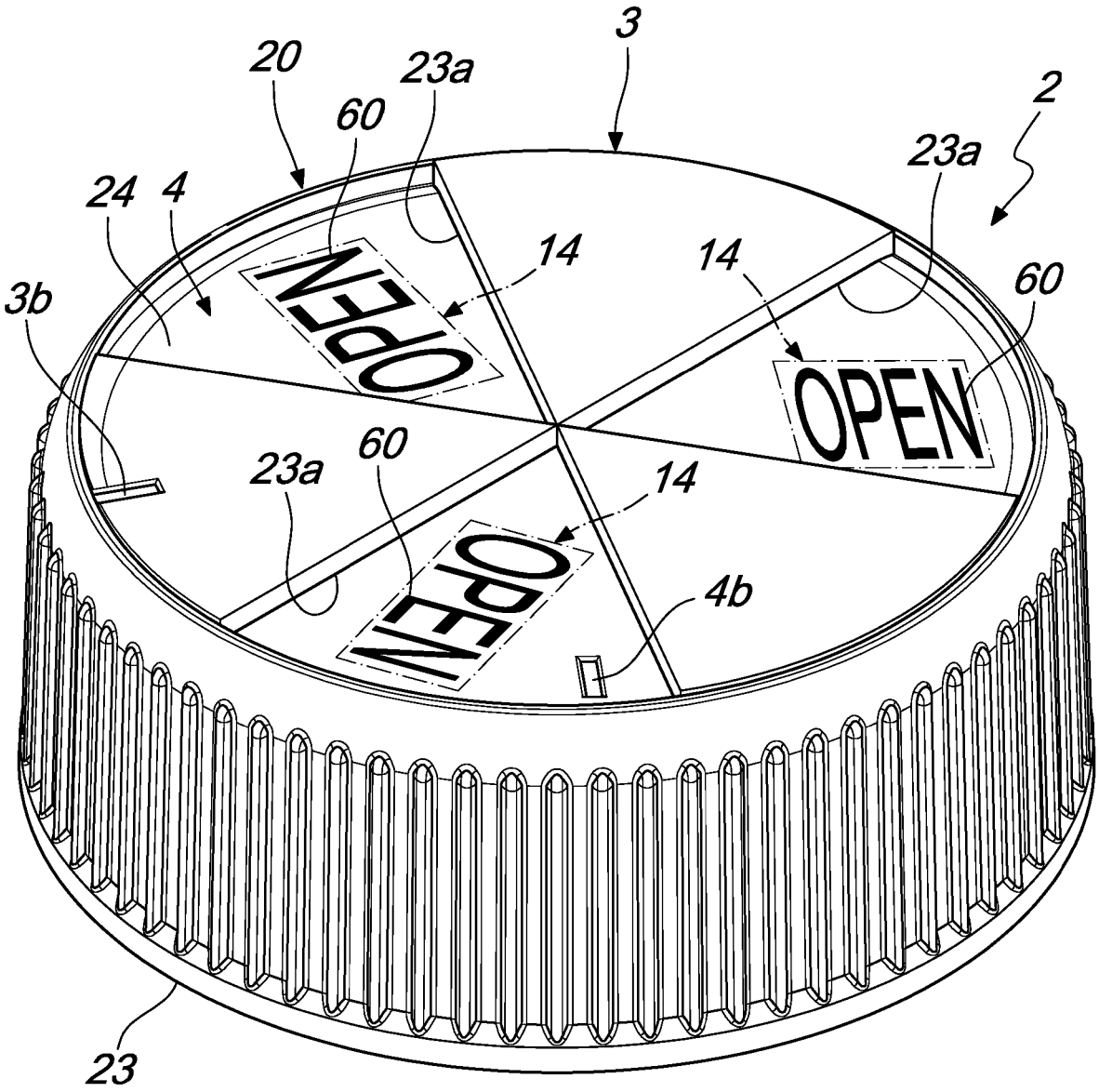
FIG. 2 is a view similar to FIG. 1 in which the safety capsule is in the opening position.
Figure 3:
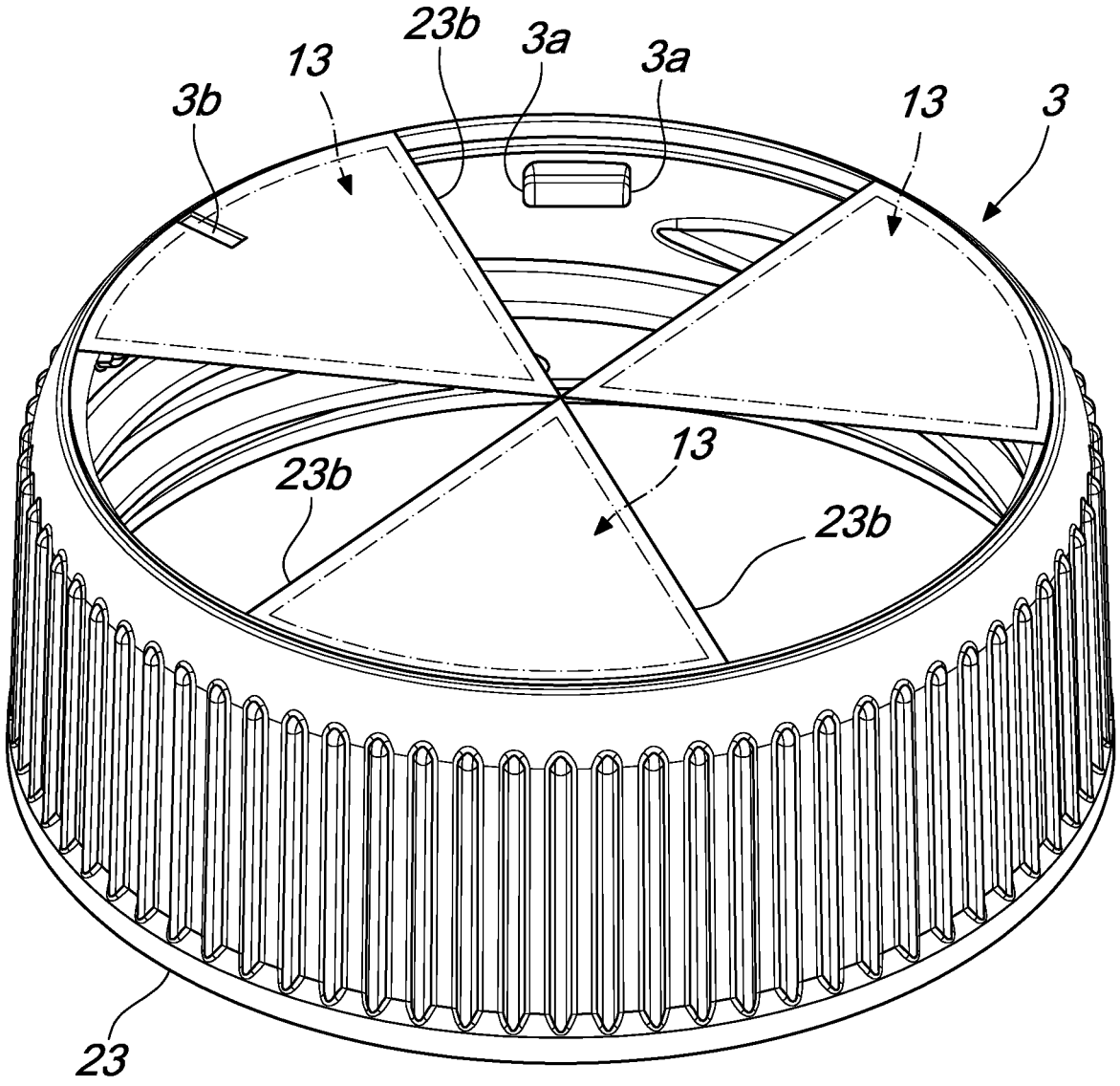
FIG. 3 is a perspective view of the outer cap of the safety capsule shown in FIGS. 1 and 2.
Figure 4:
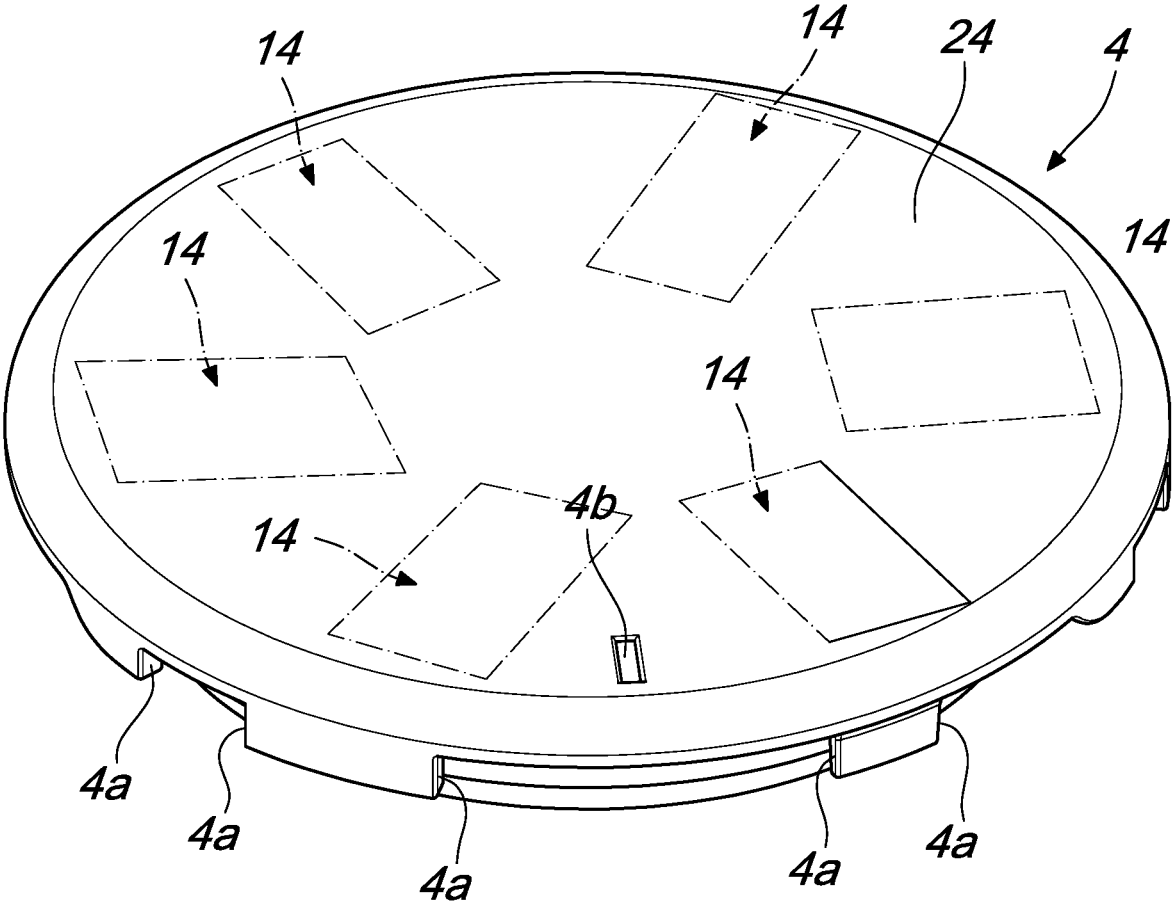
FIG. 4 is a perspective view of the inner element of the safety capsule before being printed.
Figure 5:
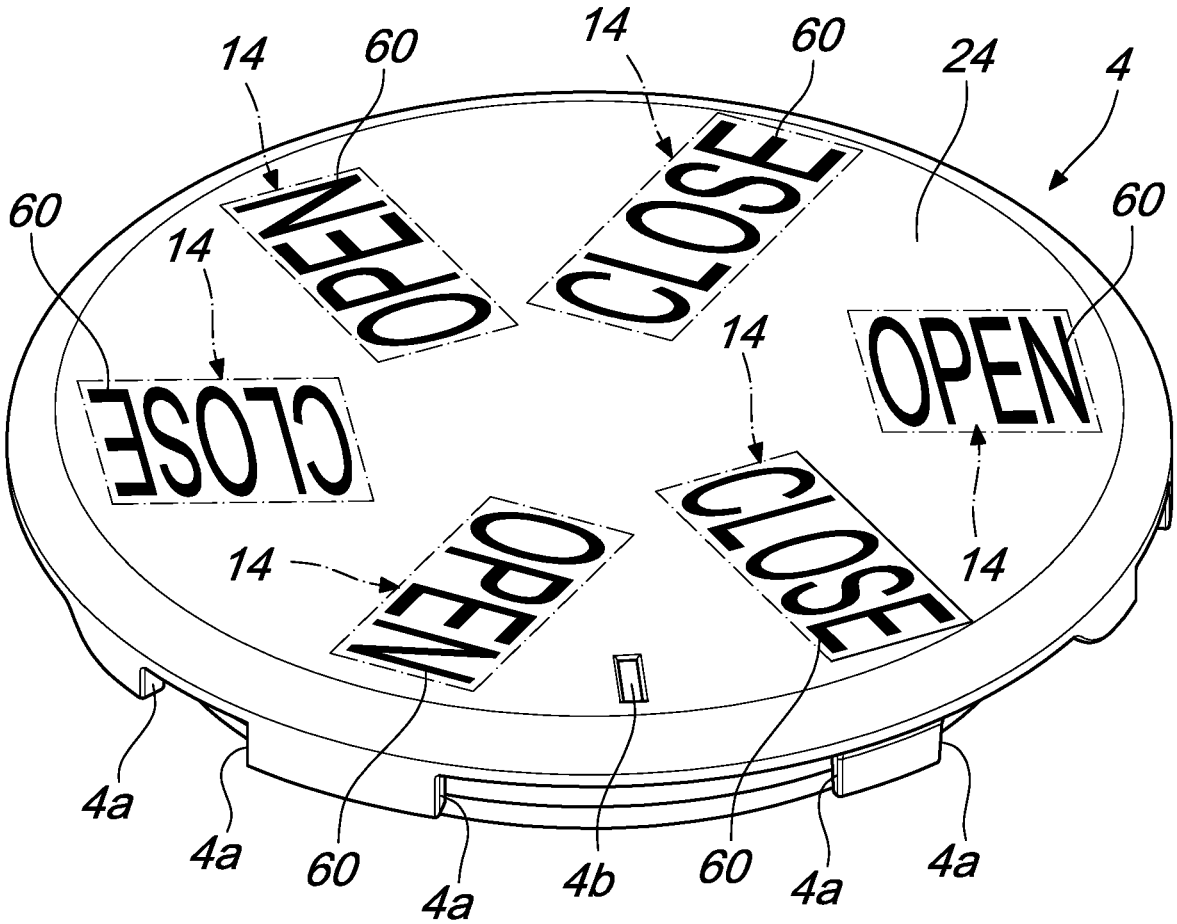
FIG. 5 is a perspective view of the inner element of the safety capsule after printing.
Figure 6:
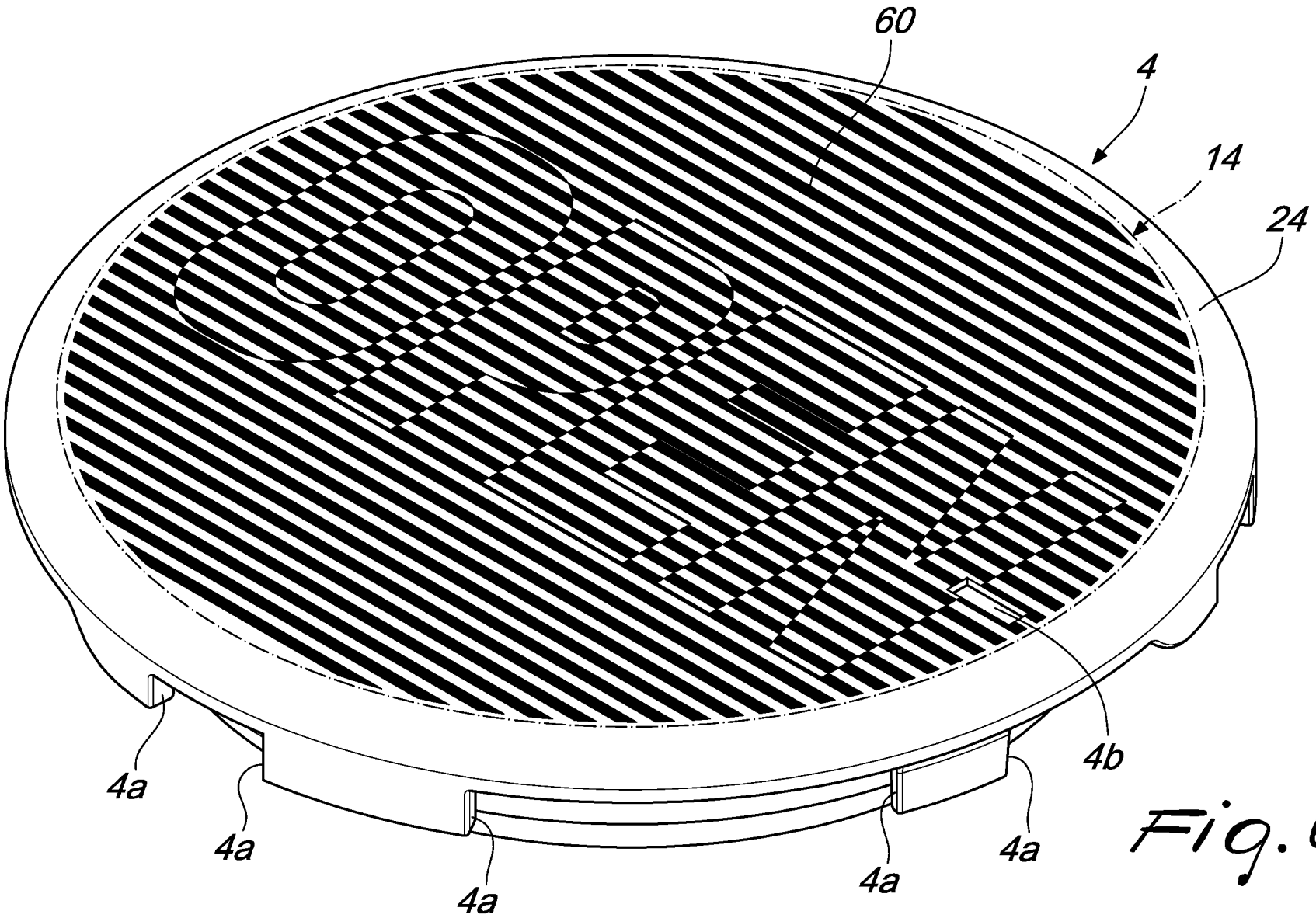
FIG. 6 is another perspective view of the inner element of the safety capsule after a different mode of printing.
Figure 7:
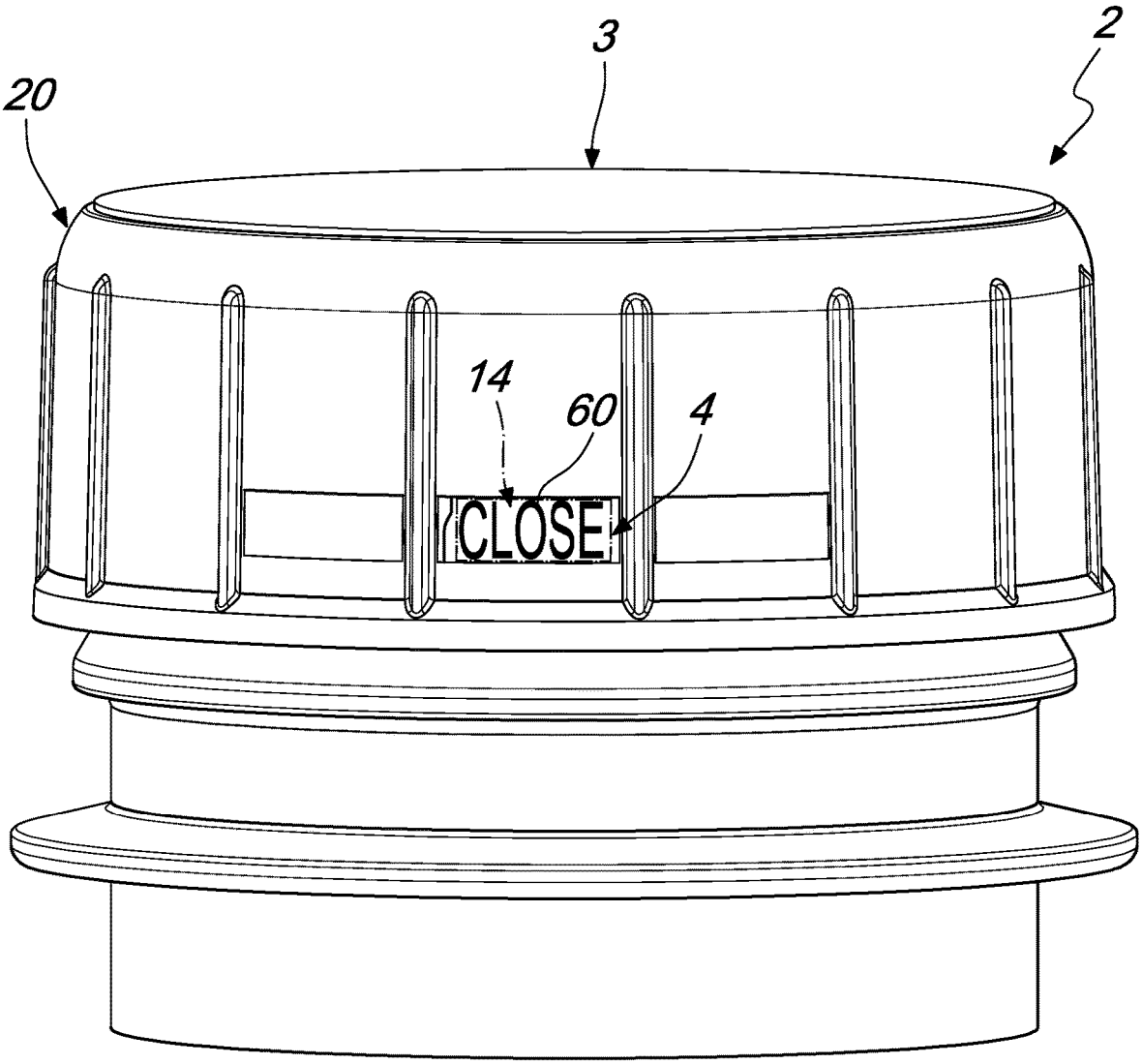
FIG. 7 is a side view of a second embodiment of a safety capsule in the closed position.

The present disclosure relates to a device 1 for printing a closure device 2 for containers.

The closure device 2 comprises a first body 3 and a second body 4 each of which has a respective relative positioning element 3*a*, 4*a*.

The relative positioning elements 3*a* and 4*a* are designed, at least in a step of use of the closure device 2, to be arranged and/or oriented with respect to each other in a predetermined position.

According to the present disclosure, the printing device 1 comprises a supporting device 11 for at least one of the bodies 3, 4, a device 12 for detecting the position or orientation of the relative positioning element 3*a*, 4*a* of the body 3, 4 supported by the support device 11, and a device 30 for digital printing of at least one portion 13, 14 of the body 3, 4 supported by the supporting device 11 in order to perform a printing operation in a predetermined position and/or with a predetermined orientation with respect to the position and/or orientation of the respective relative positioning element 3*a*, 4*a*.

Preferably, the closure device 2 comprises a safety capsule 20.

In this case, the first body 3 comprises an outer cap 23 of the safety capsule 20 which is provided with coupling means for coupling to the neck of a container 50, while the second body comprises an inner element 24 which is designed to be arranged inside the outer cap 23 and is designed to be removably associated with an opening 50*a* of the container 50.

Figure 8:
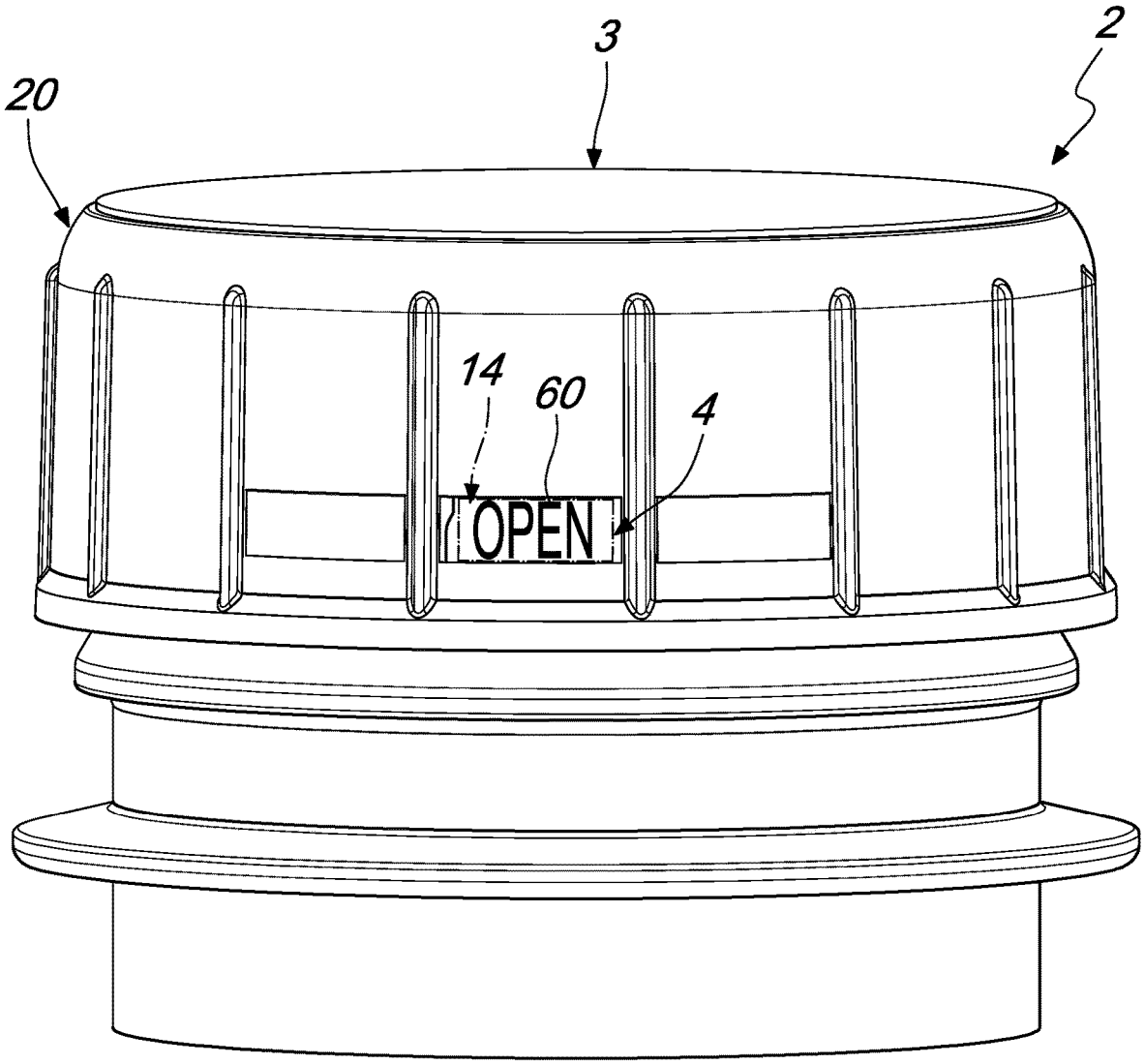
FIG. 8 is a view similar to the view in FIG. 7 with the safety capsule in the open position.
Figure 9:
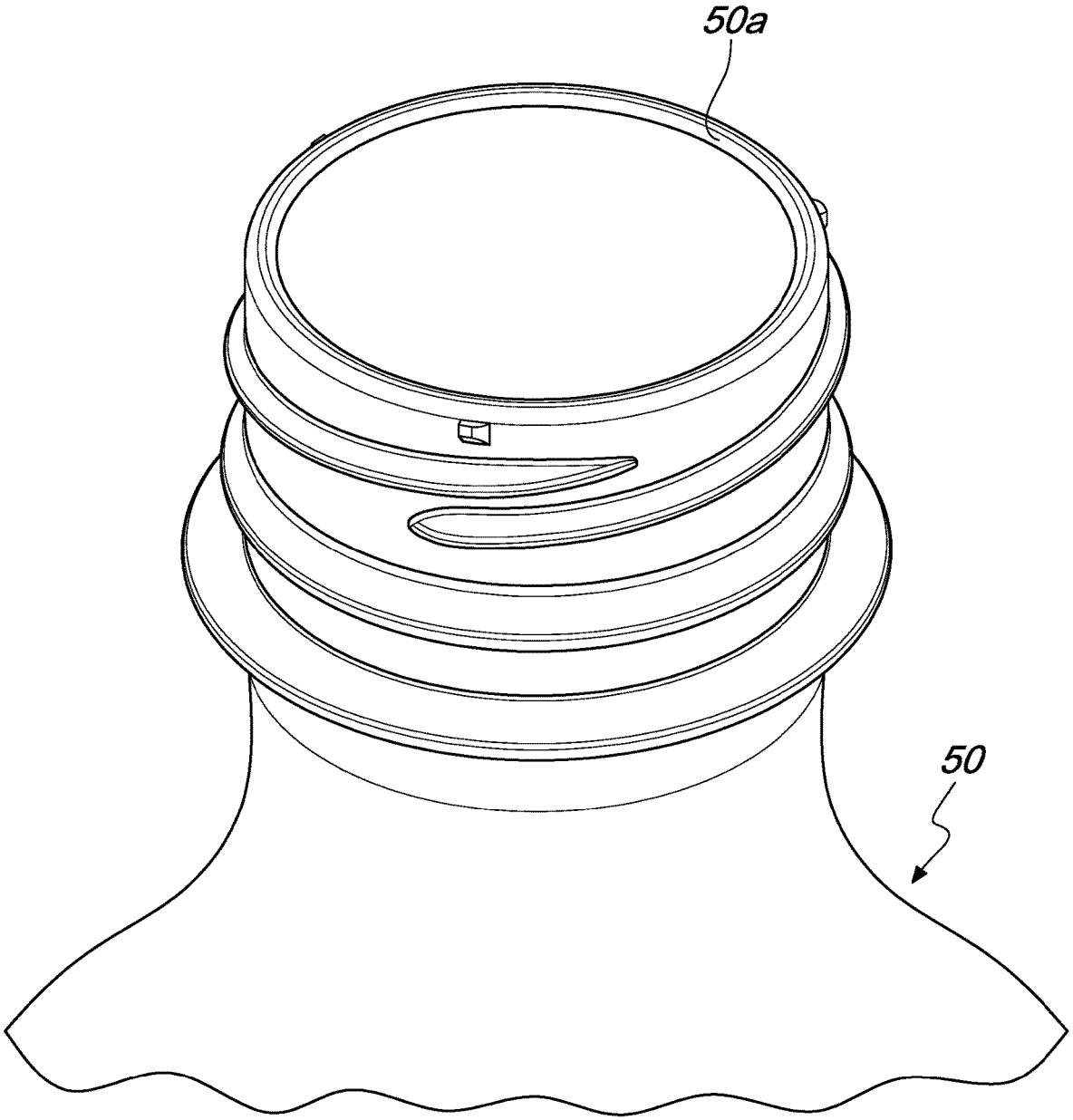
FIG. 9 is a perspective view of the opening of a container.
Figure 10:
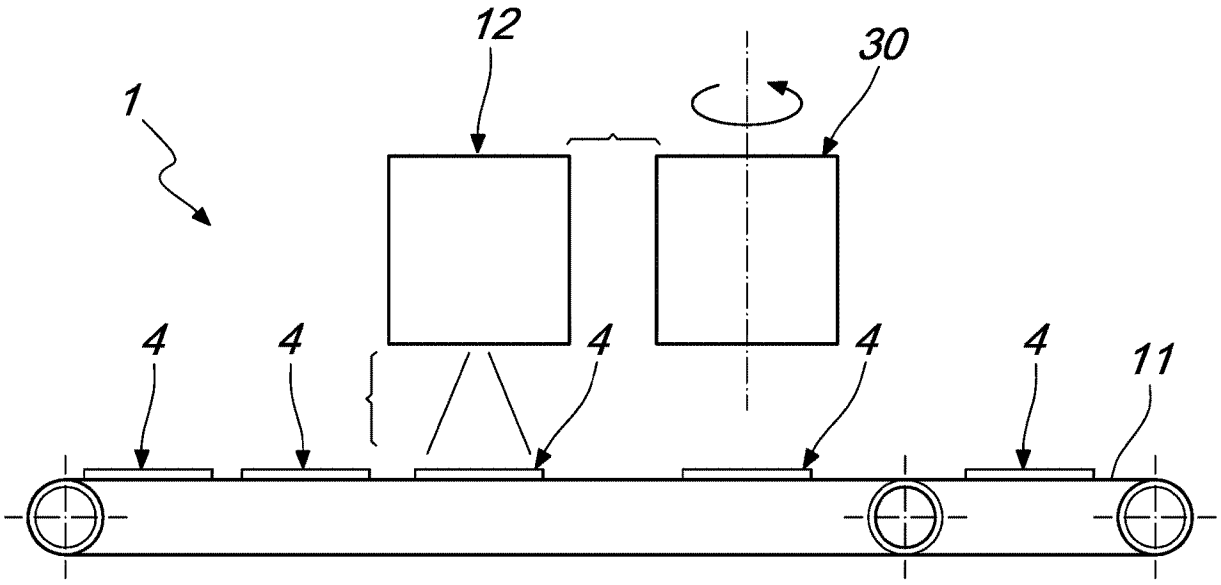
FIG. 10 is a schematic side view of the device for printing according to the disclosure.
Figure 11:
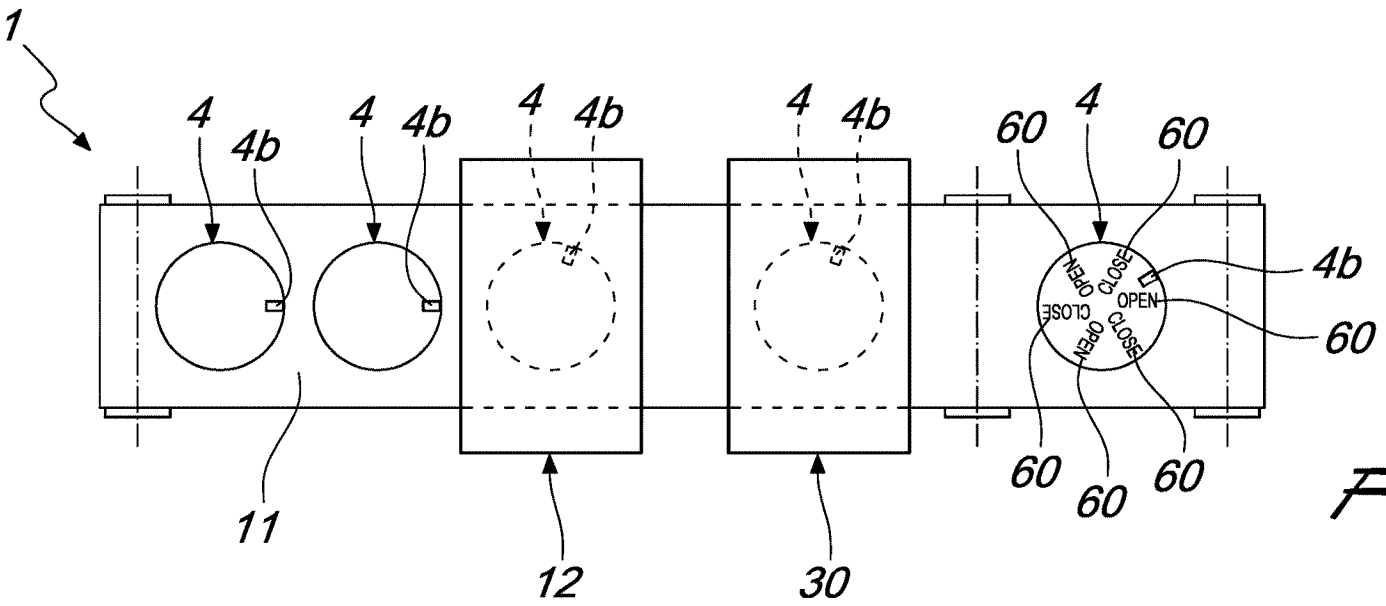
FIG. 11 is a schematic view from above of the device for printing according to the disclosure.

Alternatively (such as for example shown in FIGS. 8 and 9), the closure device 2 comprises a safety capsule 20 wherein the first body 3 comprises an outer cap 23 of the safety capsule 20 which is provided with coupling means for coupling to the neck of a container 50, while the second body 4 comprises a coupling portion that is defined at an opening 50*a* of the container 50.

In this case it is possible for a particular printing operation 60 to be carried out on the second body 4, for example on the outer surface of the neck of the container 50.

Conveniently, the relative positioning means 3*a*, 4*a* comprise engagement means, which are interposed between the first body 3 and the second body 4 and are structured so as to leave the first body 3 and the second body 4 disengaged with respect to a movement for opening or removing the outer cap 23 between a closure position and an intermediate position, and in order to render the first body 3 and the second body 4 integral with respect to the movement for opening or removing the outer cap 23 between the intermediate position and the open position.

The device 12 for detecting the position or orientation of the relative positioning element 3*a* and 4*a* can be configured to directly detect the one or more relative positioning elements 3*a* and 4*a*, or to determine their orientation on the basis of an additional reference element 3*b*, 4*b*, arranged or oriented in a predetermined fashion with respect to the respective relative positioning elements 3*a* and 4*a*.

In this regard, the reference element 3*b*, 4*b* is selected from the group comprising:

- a three-dimensional portion of the respective body 3, 4 that can be detected by the detection device 12;
- a two-dimensional region of the respective body 3, 4 that can be detected by the detection device 12;
- a magnetic element which is embedded in or associated with the respective body 3, 4 that can be detected by the detection device 12;
- a metallic element which is embedded in or associated with the respective body 3, 4 that can be detected by the detection device 12;
- an element made of a material that is different from the one that constitutes the respective body 3, 4, which is embedded in or associated with the respective body 3, 4 that can be detected by the detection device 12.

The second body 4 of the safety capsule 20 comprises, for example, a guarantee disk or other guarantee component which, at least in a configuration prior to the first opening of the safety capsule 20, is removably coupled to the neck or to the opening 50*a* of the container 50.

The outer cap 23 is, for example, provided with at least one opening 23*a* (or equivalently with at least one at least partially transparent portion 23*b*) which faces onto the underlying second body 4, which presents in an upward region at least one printed item 60 which is designed to represent the condition of the safety capsule (for example open/closed).

Upon the first opening of the safety capsule 20, the outer cap 23 and the second body 4 can rotate, or in any case move, with respect to each other between a non-aligned position, in which the indication that the first opening has occurred is not visible from outside, and an aligned position, in which the indication that the first opening has occurred is visible from outside through the opening or openings 23*a* and/or transparent portions 23*b* defined on the outer cap 23.

Preferably, the detection device 12 is functionally associated with the digital printing device 30.

Advantageously, the safety capsules 20 are cup-shaped and are made at least partially of plastic.

Specifically, once the position has been detected of the relative positioning element 3*a* and 4*a* (or more preferably reference element 3*b*, 4*b*) of the body 3, 4 supported by the supporting device 11, it is possible to command the digital printing device 30 to carry out a printing operation in a predetermined position and/or with a certain orientation with respect to the position of the relative positioning element 3*a* and 4*a*.

Specifically, the device 1 comprises means of orienting the printing operation on the basis of the detection (direct or indirect) by the detection device 12 of the respective relative positioning element 3*a*, 3*b*.

The means of orienting the printing operation can comprise means of orientation of the respective body 3, 4 or means of orientation of the digital printing device 30.

The digital printing device 30 can be arranged along a transfer device which is associated in input with a feeder of bodies 3, 4 to be printed and in output with an unloader of the printed bodies 3, 4.

The transfer device can define, advantageously, a plurality of seats to accommodate a respective body 3, 4.

The bodies 3, 4, and advantageously the respective seats if present, are movable along a transfer trajectory that has a rectilinear or curvilinear extension, for example circular.

Obviously there is no reason why different transfer devices cannot be used.

The digital printing device 30 can comprise a variable number of print heads as a function of the speed and colors required.

The digital printing device 30 comprises at least one inkjet printing device, for example with four colors (cyan, magenta, yellow and black) which constitute the basic colors with which to obtain any color combination.

The inkjet printing device can be associated with a first reservoir of colors.

If it is required to cover the surface to be printed of the closure body, for example using the color white, it is possible for the printing device 30 to comprise an additional printing station, optionally associated with a second tank, arranged upstream of the inkjet printing device along a transfer trajectory.

The additional printing station can have one or more print heads supplied, for example, with white ink.

Downstream of the inkjet printing device and optionally of the additional printing station there can be, respectively, a first and a second device for irradiating the deposited ink.

The first and/or second device for irradiating can be constituted by lamps of the UV LED type that produce an immediate reticulation of the inks; such lamps, furthermore, have extremely limited encumbrances and do not produce an excessive amount of heat.

Specifically, the second device for irradiating is intended to produce the reticulation of the optional white ink deposited by the additional printing station, while the first device for irradiating produces the reticulation of the colors deposited by the inkjet printing device.

In order to increase printing speed, it is possible to provide for the installation of two or more print heads for each individual color.

According to a further aspect, the present disclosure relates to a method of printing a closure device 2 for containers which comprises a safety capsule 20.

The closure device 2 comprises a first body 3 and a second body 4 each of which has a respective relative positioning element 3*a*, 4*a* which are designed, at least in a step of use of the closure device 2, to be arranged and/or oriented with respect to each other in a predetermined position.

The method comprises:

- a step of supporting 11, by way of a supporting device 11, at least one of the bodies 3, 4;
- a step of detecting, by way of a detection device 12, the position or the orientation of the relative positioning element 3*a*, 4*a* of the body 3, 4 that is supported by the supporting device 11;
- a step of printing, with a digital printing device 30, at least one portion 13, 14 of the body 3, 4 supported by the supporting device 11 in order to perform a printing operation 60 in a predetermined position and/or with a predetermined orientation with respect to the position and/or orientation of the respective relative positioning element 3*a*, 4*a*.

Preferably, the first body 3 comprises an outer cap 23 of the safety capsule 20 which is provided with coupling means for coupling to the neck of a container 50, while the second body comprises an inner element 24 which is designed to be arranged inside the outer cap 23 and is designed to be removably associated with an opening 50*a* of the container 50.

Alternatively (such as for example shown in FIGS. 8 and 9), the closure device 2 comprises a safety capsule 20 wherein the first body 3 comprises an outer cap 23 of the safety capsule 20 which is provided with coupling means for coupling to the neck of a container 50, while the second body 4 comprises a coupling portion that is defined at an opening 50*a* of the container 50.

In this case it is possible for a particular printing operation 60 to be carried out on the second body 4, for example on the outer surface of the neck of the container 50.

The outer cap 23 is provided with at least one opening 23*a* or at least one at least partially transparent portion 23*b* which faces onto the underlying second body 4 which presents in an upward region at least one printed item 60 which is designed to represent the condition of the safety capsule, upon the first opening of the safety capsule 20.

The outer cap 23 and the second body 4 can rotate, or move, with respect to each other between a non-aligned position, in which the indication that the first opening has occurred is not visible from outside, and an aligned position, in which the indication that the first opening has occurred is visible from outside through the opening or openings 23*a* and/or transparent portions 23*b* defined on the outer cap 23.

In practice it has been found that in all the embodiments the disclosure has achieved the intended aims and advantages.

All the characteristics of the disclosure, indicated above as advantageous, convenient or similar, may also be missing or be substituted by equivalent characteristics.

The individual characteristics set out in reference to general teachings or to specific embodiments may all be present in other embodiments or may substitute characteristics in such embodiments.

The disclosure, thus conceived, is susceptible of numerous modifications and variations, all of which are within the scope of the appended claims.

In practice the materials employed, provided they are compatible with the specific use, and the dimensions and shapes, may be any according to requirements.

Moreover, all the details may be substituted by other, technically equivalent elements.

The disclosures in Italian Patent Application No. 102016000122417 (UA2016A008741) from which this application claims priority are incorporated herein by reference.

The invention claimed is:

1. A device for printing a closure device for containers which comprises a safety capsule, wherein said closure device comprises a first body and a second body each of which has a respective relative positioning element configured to be arranged and/or oriented with respect to each other in a predetermined position, said printing device comprising: a supporting device configured for at least one of said bodies, a detection device configured for detecting a position or orientation of the relative positioning element of the body supported by said support device, and a device for digital printing of at least one portion of the body supported by said supporting device in order to perform a printing operation in a predetermined position and/or with a predetermined orientation with respect to the position and/or orientation of the respective relative positioning element, said first body comprising an outer cap of said safety capsule which is provided with coupling means for coupling to a neck of a container, and said second body comprising an inner element which is configured to be arranged inside said outer cap and is adapted to be removably associated with an opening of said container, said first and second bodies comprising at least one reference element, which is arranged or oriented in a predetermined manner with respect to the respective relative positioning elements, said at least one reference element being chosen from a group that comprises:

- a three-dimensional portion of the respective body that can be detected by said detection device;
- a two-dimensional region of the respective body that can be detected by said detection device;
- a magnetic element which is embedded in or associated with the respective body that can be detected by said detection device;
- a metallic element which is embedded in or associated with the respective body that can be detected by said detection device; and
- an element made of a material that is different from the one that constitutes the respective body, which is embedded in or associated with the respective body that can be detected by said detection device;

the detection device being configured to determine the orientation of the relative positioning element on the basis of said reference elements.

2. The printing device according to claim 1, wherein said closure device comprises a safety capsule, said first body comprising an outer cap of said safety capsule which is provided with coupling means for coupling to the neck of a container, and said second body comprising a coupling portion that is defined at an opening of said container.

3. The printing device according to claim 1, wherein said relative positioning means comprise engagement means, which are interposed between said first body and said second body and are structured so as to leave the first body and the second body disengaged with respect to a movement for opening or removing the outer cap between a closure position and an intermediate position, and in order to render the first body and the second body integral with respect to the movement for opening or removing the outer cap between the intermediate position and the open position.

4. The printing device according to claim 1, wherein said detection device is functionally associated with said digital printing device.

5. The printing device according to claim 1, wherein said outer cap is provided with at least one opening or at least one at least partially transparent portion which faces onto the underlying second body which presents in an upper region at least one printed item which is designed to represent a condition of said safety capsule.

6. A method of printing a closure device for containers which comprises a safety capsule which comprises a first body and a second body, each of which has a respective relative positioning element configured to be arranged and/or oriented with respect to each other in a predetermined position and at least one reference element arranged or oriented in a predetermined manner with respect to the respective relative positioning elements, the method including the steps of:

supporting, by way of a supporting device, at least one of said bodies, detecting the position or the orientation of said relative positioning element of the body that is supported by said supporting device, by way of a detection device that determines the orientation of the relative positioning element on the basis of said reference elements, and printing, by way of a digital printing device, at least one portion of the body that is supported by said supporting device in order to perform a printing operation in a predetermined position and/or with a predetermined orientation with respect to the position and/or orientation of the respective relative positioning element.

7. The method of printing a closure device according to claim 6, wherein said first body comprises an outer cap of the safety capsule which is provided with coupling means for coupling to the neck of a container, and in that said second body comprises an inner element which is designed to be arranged inside said outer cap and is designed to be removably associated with an opening of the container, said outer cap being provided with at least one opening or at least one at least partially transparent portion which faces onto the underlying second body which presents in an upper region at least one printed item which is designed to represent the condition of said safety capsule, upon the first opening of said safety capsule, said outer cap and said second body being rotatable, or moveable, with respect to each other between a non-aligned position, in which an indication that the first opening has occurred cannot be seen externally, and an aligned position, in which the indication that the first opening has occurred can be seen externally through the opening or openings and/or transparent portions defined on the outer cap.

* * * * *